United States Patent [19]

Langhorst

[11] 4,203,267

[45] May 20, 1980

[54] MULTIPLE STRAND TOWER GUY ASSEMBLY

[75] Inventor: Winfield S. Langhorst, Bethlehem, Pa.

[73] Assignee: Bethlehem Steel Corporation, Bethlehem, Pa.

[21] Appl. No.: 929,612

[22] Filed: Jul. 31, 1978

[51] Int. Cl.[2] ..... E04H 12/20

[52] U.S. Cl. ..... 52/148; 24/122.6; 403/169

[58] Field of Search ..... 52/146, 148; 24/122.6; 403/169, 177, 178; 14/21, 22

[56] References Cited

U.S. PATENT DOCUMENTS

| | | | |
|---|---|---|---|
| 1,793,381 | 2/1931 | Vanetta et al. | 52/148 |
| 2,198,809 | 4/1940 | Finke et al. | 14/21 |
| 3,182,371 | 5/1965 | Pieper | 24/135 |
| 3,344,452 | 10/1967 | Quimby | 52/148 X |
| 3,443,374 | 5/1969 | Carnevale | 57/149 |
| 4,121,325 | 10/1978 | Bruinette et al. | 24/122.6 |

*Primary Examiner*—Ernest R. Purser

*Attorney, Agent, or Firm*—Joseph J. O'Keefe; Michael J. Delaney; Anson W. Biggs

[57] ABSTRACT

Apparatus for use in guying transmission towers or the like which comprises an assembly of a plurality of lengths of wire strands which are anchored to a tension equalizer device at one end of the strand lengths and terminate in a single wire rope socket at the other ends thereof.

4 Claims, 4 Drawing Figures

2
32
33
30
31
18
10
17
16
15
14
12
23
24
11
21
22
20

13

MULTIPLE STRAND TOWER GUY ASSEMBLY

BACKGROUND OF THE INVENTION

This invention relates generally to tower guys and more particularly to a unique assembly of strands to form a tower guy.

The increased use of EHV (extra heavy voltage), e.g. 500 KV and 750 KV, power transmission lines has resulted in the design of a variety of towers. Many of these towers are as much as 100 feet high and are guyed. Installation of some of these towers has been by use of helicopter lifts from the assembly point to the erection site. Tower foundations are set beforehand and the assembled tower is carried to the site by helicopter. During tower erection the guys attached to the tower are initially tensioned as the tower is set on its foundation which permits the release of the helicopter. Crews then return to complete the tower plumbing by adjusting the guy tension to the proper value.

Guy strands used on utility towers are often single lengths of $\frac{3}{4}''$ or $\frac{7}{8}''$ diameter $1\times19$ construction. Such strands are more expensive than multiple parallel $1\times7$ strands of smaller diameter having a composite breaking strength equal to or exceeding that of the $1\times19$ strand.

A $1\times7$ strand is defined as having a center wire around which six wires are twisted in a helical fashion. All seven wires are of the same nominal diameter.

A $1\times19$ strand is defined as having a center wire around which a first layer of six wires are twisted in a helical fashion. A second layer of twelve wires is twisted in helical fashion over the first layer of six wires. All nineteen wires are of the same nominal diameter.

Prior to this invention multiple strands used for guying involved individual fastening of each of the strands at the tower and to a tension equalizing device at the ground anchor in a costly and complex procedure.

SUMMARY OF THE INVENTION

It is therefore an object of the instant invention to provide economical apparatus for guying towers.

It is a further object of the invention to provide a multiple strand guy assembly terminating at a tension equalizer at one end thereof and terminating in a single socket at the other end.

The invention accomplishes these objects by providing a multiple strand guy assembly comprising at least three lengths of wire strand attached at one end thereof to a tension equalizer and at the other ends attached to a single wire rope socket. The use of a plurality of strands develops the strength of the more costly single strand installation.

This invention provides an economical multi-strand guying system, which uses three small 7-wire strands as an alternate to a heavier single 19-wire strand. The principal use is for guying transmission towers but is applicable to any installation where guys are used.

The advantages of the multiple strand guying system of this invention include (a) lower cost for the strand and anchorage hardware, (b) cutting and socketing the strand at the producing plant rather than in the field which offers further economy and provides better quality control, (c) less costly erection particularly in savings of helicopter time when applicable, and (d) the multiplicity of strands in a bundled configuration provides a safety factor.

DETAILED DESCRIPTION

Wire strand is used for supporting and carrying purposes. Some of the common uses of wire strand are for guying poles, towers, smokestacks, and similar structures.

Wire strand is regularly made in three constructions: 3-wire, 7-wire and 19-wire. The sizes of the strands range from approximately 3/16 inch to 1 inch in diameter.

For the purposes of the description of the instant invention it will be understood that by 7-wire strand is meant a strand in which there are six single wires of the same diameter helically wound around a king or core wire. The king wire can be of the same nominal or slightly larger diameter than the other six wires. The lay may be either left or right hand lay. The lay refers to the direction of twist of successive layers of wires over the king or core wire as well as the direction of twist of successive layers of wires over other layers of wires.

Similarly, a 3-wire strand has two single wires of the same diameter helically wound around a king or core wire and a 19-wire strand has eighteen single wires of the same diameter helically wound around a king or core wire.

Figures 1, 2:
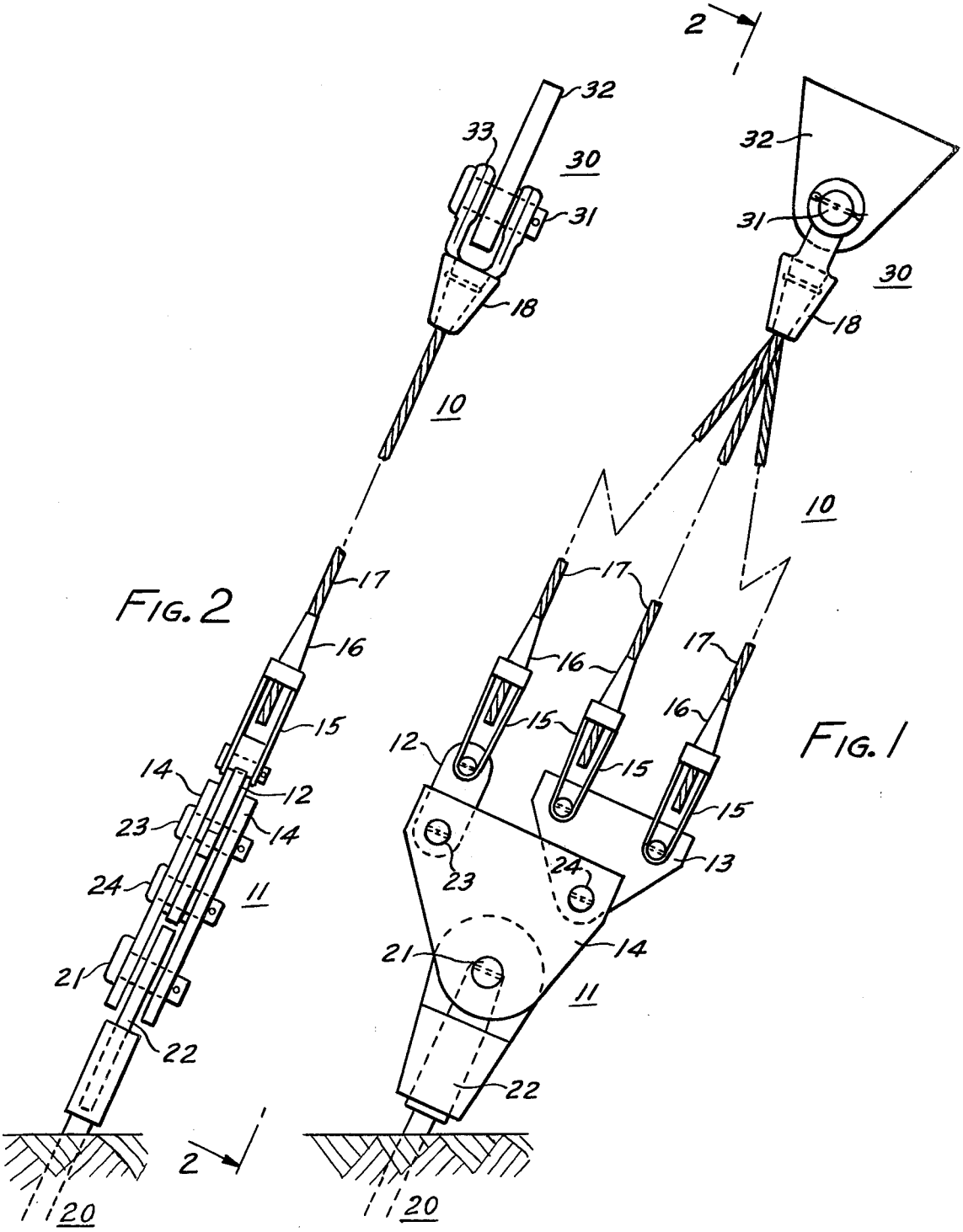
FIG. 1 is a view of the multiple strand tower guy assembly in the plane of the strands.
FIG. 2 is a side view of the assembly of FIG. 1 taken on line 2—2 of FIG. 1.

Referring now to the drawings for a detailed description of the invention and particularly to FIGS. 1 and 2, the guy assembly 10 is seen to comprise generally tension equalizer assembly 11, load leveler plates 12, 13 and 14, links 15, clamps 16, strands 17 and wire rope socket 18. The tension equalizer assembly 11 is secured to first anchor means, e.g. ground anchor 20 by pin 21 and socket 22. The ground anchor 20 further comprises, e.g., a plate or concrete abutment buried in the ground to which a tie rod or strand or rope assemblies are secured. These tie rods or strand or rope assemblies are removably attached to the tension equalizer assembly 11.

Second anchor means, e.g. anchor 30 provides means for attachment of wire rope socket 18 to the guyed structure, e.g. a transmission tower. Pin 31 secures the wire rope socket 18 to plate member 32.

The multiple strand guy assembly 10 comprises first anchor means, e.g. ground anchor 20, tension equalizer 11 connected thereto, a second anchor means, e.g. anchor plate 30 spaced from first anchor means 20 and including a single wire rope socket 18. The guy assembly 10 further includes a plurality of strands 17 with each strand terminating at one end thereof attached to the tension equalizer 11 and terminating at the other end secured in the single wire rope socket 18.

More specifically the tension equalizer assembly 11 comprises a pair of plates 14 which are pinned to ground anchor 20 at pin 21. Load equalizer plates 12 and 13 are pinned to the pair of plates 14 at pins 23 and 24 respectively. The end attachment for terminating one end of a length of wire strand 17 to the tension equalizer 11 consists of a forged tapered sleeve or clamp 16 with internal tapered, spring loaded jaws which engage the wire strand end. A bail or link 15 transfers the load from the clamp 16 to the load equalizer plates 12 and 13. The three strands 17 of assembly 10 are each terminated at one end thereof attached to a clamp 16 of the tension equalizer assembly 11. The other ends of the three strand lengths are terminated in a single wire socket 18 by any convenient means known to those skilled in the art, e.g. molten zinc, or potting resin. The wire rope socket 18 is provided with a bifurcated end 33 so that tower anchor plate 32 can be inserted in end 33 and pin 31 secures the attachment of the multiple strand guy assembly to the tower (not shown).

Figure 3:
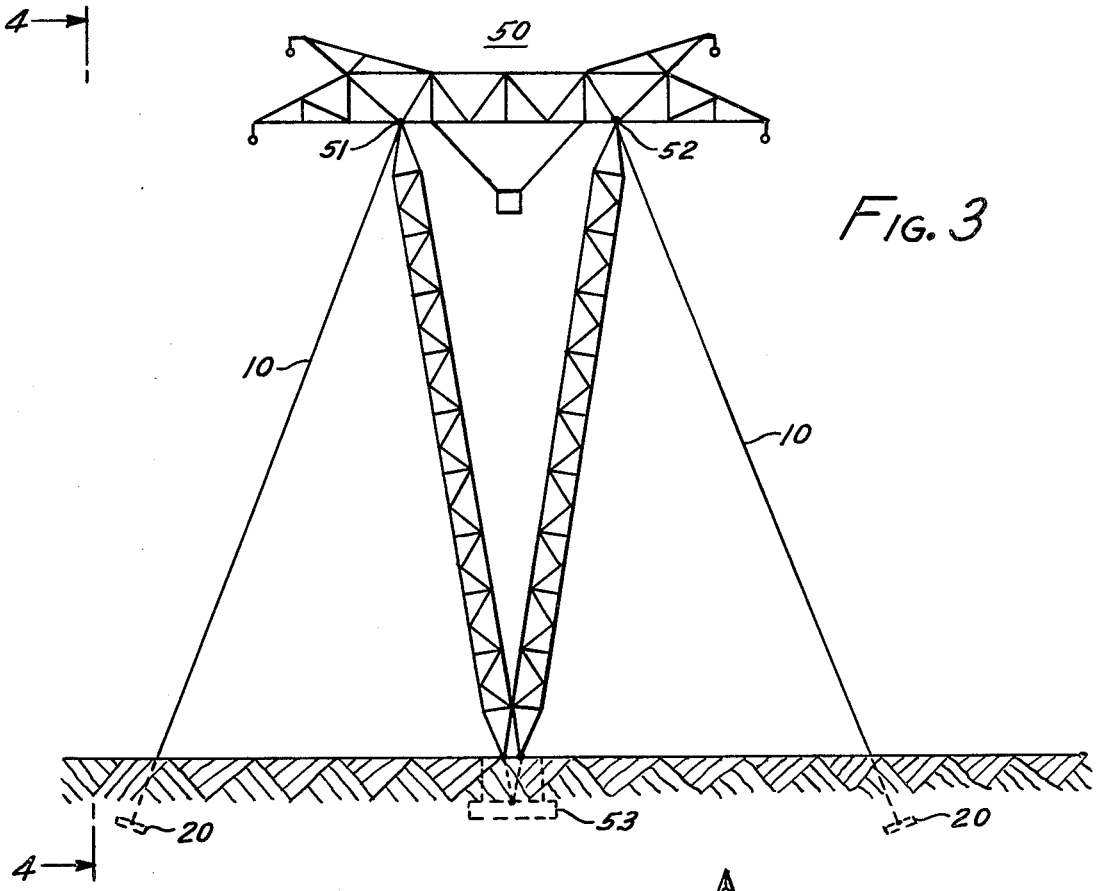
FIG. 3 is a schematic arrangement of a typical tower installation using the device of the instant invention.
Figure 4:
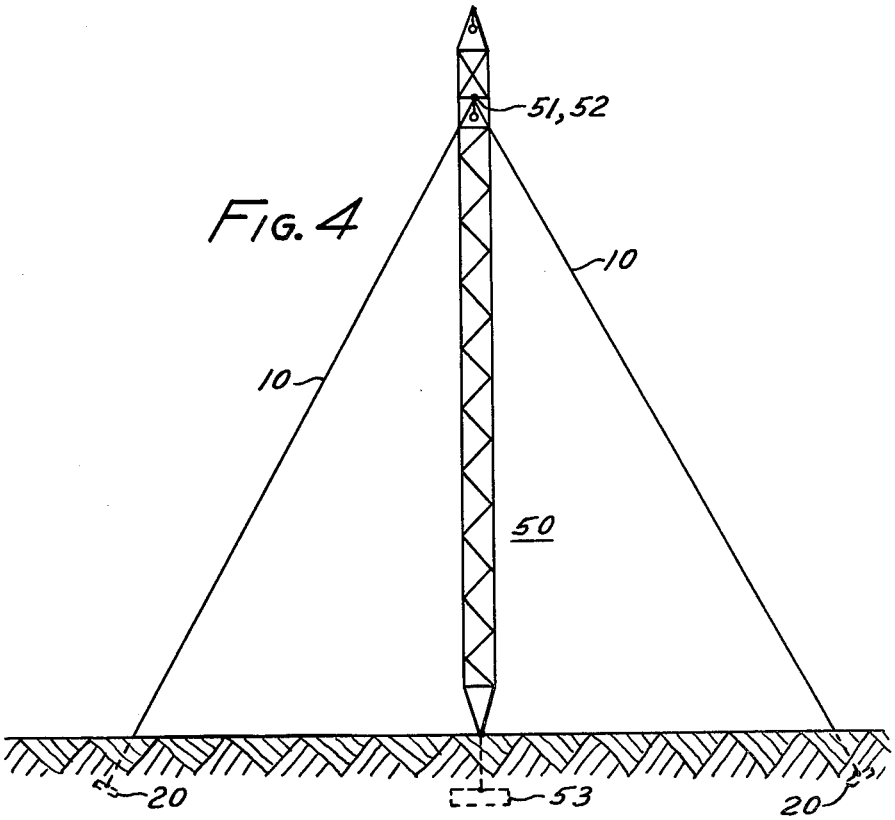
FIG. 4 is a view along line 4—4 of FIG. 3.

Referring now particularly to FIGS. 3 and 4, four multiple strand guy assemblies 10 described hereinabove are attached to transmission tower 50 at points 51 and 52 at a fabrication site and the tower 50 may then be moved to the erection site by helicopter. Temporary bands, e.g. plastic, may be used to bundle the strands 17 together to prevent tangling in transport. A tension equalizer assembly 11 is in place attached to a ground anchor 20 at the erection site. When the helicopter is released from the tower a follow-up crew secures all attachment points by equalizing tensions on all guy strands.

Resin sockets 18 and zinc poured sockets have been successfully tested to develop the full breaking strength of the strands. Sockets using potting resin material have demonstrated improved fatigue characteristics and more convenience in forming than the poured molten zinc sockets.

The following table compares minimum breaking strengths of some typical multiple strand guys as compared to single strand guys. The figures are based on using EHS (ASTM Extra High Strength) strand with an ASTM class A coating (zinc coating applied to a carbon steel wire):

| Single Strand Size 19-wire construction | Minimum Breaking Strength Lbs. | Multi-Strand Size 7-wire construction | Minimum Breaking Strength Lbs. |
|---|---|---|---|
| 3/4" | 58,300 | Three (3) 7/16" | 62,400 |

-continued

| Single Strand Size 19-wire construction | Minimum Breaking Strength Lbs. | Multi-Strand Size 7-wire construction | Minimum Breaking Strength Lbs. |
|---|---|---|---|
| 7/8" | 79,700 | Three (3) 1/2" | 80,700 |

A class A coating will vary in weight directly as the wire size increases.

Although the description has referred to the application of specific construction of strand to the multiple guy strand assembly it should be understood that any strand construction may be equally adaptable to be so applied and is within the purview of the invention.

In addition to variations in construction, strength as well as coating weight may vary dependent on the job need but within the scope of ASTM A-475.

I claim:

1. A multiple strand guy assembly comprising:

(a) a plurality of wire strand lengths each length having a first end and a second end, (b) a first anchor means, (c) tension equalizer means connected to the first anchor means and to the first end of each of the plurality of wire strand lengths, and (d) a second anchor means spaced from the first anchor means and including a single wire rope socket having the second end of each of the plurality of wire strand lengths anchored together in a socketing material selected from a group consisting of resin and zinc in the single wire rope socket.

2. A multiple strand guy assembly according to claim 1 wherein the first anchor means is a ground anchor.

3. A multiple strand guy assembly according to claim 1 wherein the plurality of wire strand lengths includes at least three strands.

4. A multiple strand tower guy assembly comprising:

(a) a ground anchor, (b) tension equalizer means connected to the ground anchor, (c) at least three wire strand lengths each having a first end and a second end, the first end being attached to the tension equalizer, (d) a single wire rope socket anchored to the tower, and (e) the second end of each of the three wire strand lengths anchored together in a socketing material selected from a group consisting of resin and zinc in the single wire rope socket.

* * * * *